United States Patent [19]

Nishikawa

[11] 4,433,038

[45] Feb. 21, 1984

[54] ELECTROPHOTOGRAPHIC COPYING PROCESS INVOLVING SIMULTANEOUS CHARGING AND IMAGING

[75] Inventor: Masaji Nishikawa, Hachioji, Japan

[73] Assignee: Olympus Optical Company Ltd., Tokyo, Japan

[21] Appl. No.: 319,327

[22] Filed: Nov. 9, 1981

[30] Foreign Application Priority Data

Nov. 12, 1980 [JP] Japan ..... 55-158090

[51] Int. Cl.[3] ..... G03G 13/22

[52] U.S. Cl. ..... 430/55; 430/100; 430/57; 430/902; 355/3 CH

[58] Field of Search ..... 430/55, 100, 57

[56] References Cited

U.S. PATENT DOCUMENTS 3,481,669 12/1969 Roth et al. ..... 430/55 X
3,834,809 9/1974 Yoshizawa et al. ..... 430/55 X

FOREIGN PATENT DOCUMENTS 40-68992 11/1968 Japan .
41-20584 7/1972 Japan .
43-92128 8/1973 Japan .
43-68510 6/1974 Japan .

*Primary Examiner*—John D. Welsh
*Attorney, Agent, or Firm*—Weinstein & Sutton

[57] ABSTRACT

An electrophotographic copying process utilizes a photosensitive member for electrophotography which comprises a first and a second photoconductive layer which are sensitive to radiation of a first and a second wavelength region, respectively. The photosensitive member may be selectively subjected to (A) a step of charging the photosensitive member simultaneously with an irradiation thereof with an image of an original which is formed by radiation of the first wavelength region, followed by a uniform exposure by radiation of the second wavelength region, whereby a charge trapped in a portion of the photosensitive member corresponding to the dark area of the image defines a positive electrostatic latent image, or (B) a step of charging the photosensitive member simultaneously with an irradiation thereof with an image of an original which is formed by radiation of the first wavelength region, followed by an inverse charging which reduces the surface potential to substantially zero potential, and which is in turn followed by a uniform exposure to radiation of the first wavelength region, whereby a charge trapped in a portion of the photosensitive member corresponding to a bright area of the image defines a negative electrostatic latent image.

4 Claims, 18 Drawing Figures

FIG. 8 (II)

FIG. 8 (III)

FIG. 10(III)
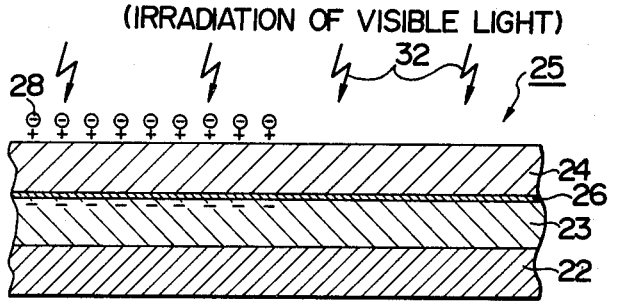

ELECTROPHOTOGRAPHIC COPYING PROCESS INVOLVING SIMULTANEOUS CHARGING AND IMAGING

BACKGROUND OF THE INVENTION

The invention relates to an electrophotographic copying process, and more particularly, to an electrophotographic copying process which permits either a positive or a negative copy image, as considered with respect to the image of an original, to be selectively obtained.

A variety of electrophotographic copying processes have been proposed in the prior art which permit a positive or a negative copy image, as considered with respect to the image of an original, to be selectively and arbitrarily obtained. One technique utilizes a photosensitive member 1 for electrophotography as shown in FIG. 1 which includes a conductive layer 2 on which a photoconductive layer 3 is laminated. FIG. 2(I) illustrates a procedure followed when a positive copy image of an original is desired. As shown, the photosensitive member is initially charged to the negative polarity in a uniform manner and is then subjected to an imagewise irradiation to form an electrostatic latent image. A toner 4 which is charged to the positive polarity is deposited on the latent image for developing purpose, and the toner image is transferred onto a record sheet to provide a positive copy image. On the other hand, FIG. 2(II) illustrates a procedure followed when a negative copy image is desired. Initially the photosensitive member is uniformly charged to the positive polarity, in contradistinction to the initial charging to the negative polarity as illustrated in FIG. 2(I), and is then subjected to an imagewise exposure to form an electrostatic latent image. Again a toner 4 which is charged to the positive polarity is deposited on the latent image to produce a toner image, which is then transferred onto a record sheet to produce a negative copy image. To enable these procedures, it is essential that the photoconductive layer 3 exhibits substantially uniform charge retention and light sensitivity when it is charged to either the positive or the negative polarity. Zinc oxide is known as a suitable material to form the photoconductive layer 3 which satisfies such requirement.

However, it is to be noted that the above requirement is not satisfied by a number of photosensitive materials including Se, Se alloys, PVK (polyvinyl carbazole) containing sensitizer or the like which are frequently used in an electrophotographic system of toner image transfer type. Accordingly, the choice of material which forms the photoconductive layer 3 is greatly limited when the above procedures are to be adopted. In addition, when the above procedure illustrated in FIG. 2(II) is employed to produce a negative copy image, the toner 4 which is charged to the positive polarity is deposited on a region corresponding to the bright areas of a light image where no charge of the latent image is present, and hence it exhibits a reduced adherence, thus causing an inconvenience that a negative image of a satisfactory optical density cannot be obtained.

Another electrophotographic copying process which selectively produces a positive and a negative copy image is illustrated in FIG. 3 where a photosensitive material 5 for electrophotography is employed which comprises a conductive layer 6 carrying a successive lamination of a photoconductive layer 7 and another photoconductive layer 8 which is sensitive to the ultraviolet region of the spectrum. When it is desired to obtain a positive copy image of an original, a source of radiation 9 which supplies a radiation including ultraviolet ray is utilized to illuminate an original 10, as shown in FIG. 4(I), and the light image of the original is projected through a projection lens 11 onto the photosensitive member 5 while simultaneously utilizing a corona charger 12 to charge the photosensitive member 5 to the negative polarity, for example, thus forming an electrostatic latent image. A toner which is charged to the positive polarity is deposited principally on the dark areas of the light image to form a toner image, which is then transferred onto a record sheet to produce a positive copy image. When it is desired to produce a negative copy image, an ultraviolet cut-off filter 13 is interposed between the source 9 and the original 10, as shown in FIG. 4(II), thus allowing the original 10 to be illuminated by visible light. The resulting light image is projected onto the photosensitive member 5 through the projection lens 11 while sinultaneously charging the photosensitive member to the same polarity as used during the formation of the positive image by means of the corona charger 12, thus forming an electrostatic latent image. A toner which is charged to the positive polarity is deposited principally on the bright areas of the light image to form a toner image, which is then transferred onto a record sheet to produce a negative copy image.

In the process described immediately above, the toner is deposited on those areas of the light image where the charge of the latent image is present when either a positive or a negative image is to be produced, and hence the resulting toner image has an increased magnitude of adherence, permitting a copy image of a relatively high optical density to be obtained. However, with this process, the positive or the negative copy image is selectively produced by the use of either radiation containing ultraviolet ray or visible light, and this causes inconveniences as mentioned below.

Specifically, the distribution of radiation from a usual light source contains little or no emission of ultraviolet ray. In addition, a projection lens generally exhibits a reduced transmissivity to the ultraviolet ray. The combination of these facts makes it difficult to achieve a selective projection of radiation including ultraviolet ray in one instance and visible light in another by utilizing the same light source and the same projection lens. Furthermore, with this process, there is a high residual potential in the non-image region, namely, in the bright areas of the light image where the positive image is to be obtained as illustrated in FIG. 4(I), or in the dark areas of the light image where the negative image is to be obtained as illustrated in FIG. 4(II), resulting in an image which is highly influenced by fogging. This is because an electrostatic latent image having a high contrast cannot be formed in either instance because of the incapability of providing a photoconductive layer 7 which satisfies the both requirements for producing the positive and the negative image. More specifically, when a positive image is to be produced by a procedure as illustrated in FIG. 4(I), a sufficiently high dark resistance and a high sensitivity are required for the both photoconductive layers 7 and 8. By contrast, when a negative image is to be produced by a procedure illustrated in FIG. 4(II), a high sensitivity and a reduced dark resistance is required of the photoconductive layer 7, and this requirement is opposite from the requirement imposed upon the photoconductive layer 7 when producing a positive image.

SUMMARY OF THE INVENTION

It is an object of the invention to eliminate the above disadvantages of the conventional processes by providing an electrophotographic copying process which permits both a positive and a negative copy image of a high image quality to be obtained selectively and easily.

The copying procedure to produce a positive copy image differs from the copying procedure to produce a negative copy image only in the presence or absence of an inverse charging step and in respect of the regions of wavelengths which are used in the immediately following uniform exposure. Accordingly, in accordance with the invention, a change between a positive and a negative latent image can be easily achieved. The formation of the positive image, which generally represents a preponderance of proportion of the need to produce copies, can be completed with a reduced number of steps. For either a positive or a negative latent image, the toner is deposited on those regions where the charge of the latent image is present, thus resulting in an increased magnitude of adherence of the toner and hence an improved image quality of the copy image.

The process of the invention is also adapted to be used in a multi-cycle process in which an electrostatic latent image which is once formed on a photosensitive member is repeatedly subjected to a developing and a transfer step to produce a plurality of positive or negative copies. In this instance, the second or outer photoconductive material is only required to have a sensitivity to the ultraviolet ray, and does not require any sensitizing treatment to impart a sensitivity to the visible region of the spectrum. Accordingly, it is a simple matter to provide a photoconductive layer which maintains an excellent charge retention over time, and this means that the electrostatic latent image can be maintained stabilized over a number of copies. In particular, when a positive copy image is to be produced, the electrostatic latent image is formed by the charges which are trapped on the both surfaces of the first photoconductive layer, and thus is not in direct contact with a developer, preventing any leakage of the charge defining the latent image through the developer as a number of copies are being produced.

It is also to be understood that the process of the invention is effectively applicable to an electrophotographic system of the type utilizing a photosensitive member in the form of a screen on which an electrostatic latent image is formed to modulate a current of corona ions to cause a transfer of the latent image onto a record sheet, whereupon it is developed with toner.

DESCRIPTION OF PREFERRED EMBODIMENT

Figure 1:
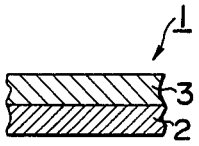
FIG. 1 is a schematic cross section of one form of a photosensitive member for electrophotography which is used in the conventional electrophotographic copying process.
Figure 2I:
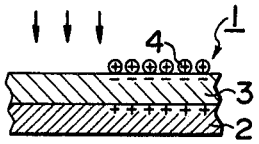
FIG. 2(I) (PRIOR ART)
FIGS. 2(I) and (II) schematically illustrate copying steps utilized with the photosensitive member shown in FIG. 1.
Figure 2:
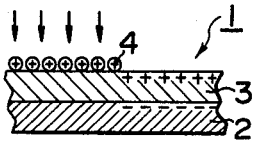
FIG. 2(II) (PRIOR ART)
Figure 3:
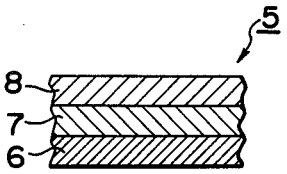
FIG. 3 is a schematic cross section of another form of photosensitive member for electrophotography used in the prior art.
Figure 4I:
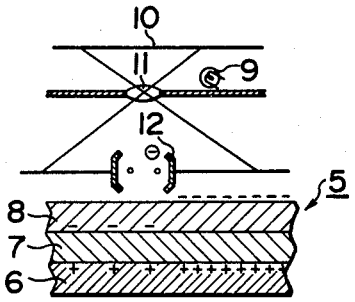
FIG. 4(I) (PRIOR ART)
FIGS. 4(I) and (II) schematically illustrate copying steps used with the photosensitive member shown in FIG. 3.
Figure 4:
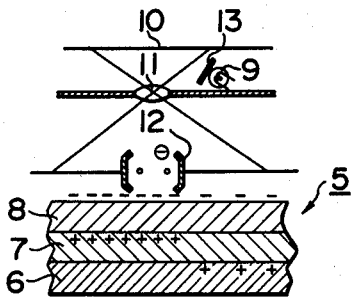
FIG. 4(II) (PRIOR ART)
Figure 5:
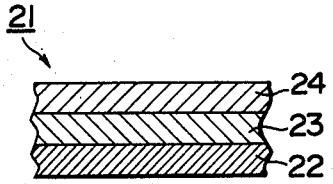
FIG. 5 is a schematic cross section of one form of photosensitive member for electrophotography which is used in the present invention.

Referring to FIG. 5, there is shown one form of photosensitive member for electrophotography which may be used in the electrophotographic copying process of the invention, in schematic cross section. A photosensitive member 21 shown comprises a conductive layer 22 carrying a successive lamination of a first photoconductive layer 23 which is sensitive to visible light (radiation in a first wavelength region), and a second photoconductive layer 24 which transmits the visible light and which is sensitive to radiation different from the radiation in the first wavelength region or to ultraviolet ray or light in the visible region which is close to the ultraviolet region of the spectrum (radiation in the second wavelength region). The conductive layer 22 is also effective as a support for the entire photosensitive member 21, and may be formed by a metal such as aluminium or a polyester film having a metallized surface. The first photoconductive layer 23 which is sensitive to radiation in the first wavelength region may comprise Se, Se alloys, amorphous silicon, CdS, ZnO and PVK containing a sensitizer such as TNF (2,4,7-trinitro-9-fluorenone) or the like, which are in themselves known in the art. The second photoconductive layer 24 which is sensitive to radiation in the second wavelength region may comprise PVK, amylhydrazones, oxazoles, pyrazolidones, 4–5 diphenyl imidazoles, 1,3,4 triazoles, oxydiazoles, perillenes, for example. However, since the material which forms the first photoconductive layer 23 is generally sensitive to ultraviolet ray in addition to visible light, it is desirable that the material to form the second photoconductive layer 24 be selected in connection with the material to form the first photoconductive layer 23 so that radiation in the second wavelength region cannot reach the first photoconductive layer 23, or stated differently, so that the second photoconductive layer has a good absorption of radiation in the second wavelength region.

Figure 6:
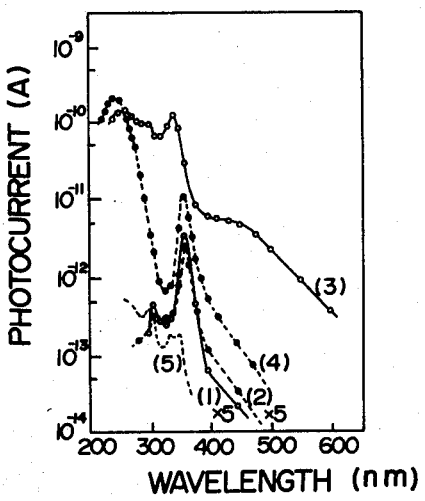
FIG. 6 graphically shows the spectral photocurrent response and absorption spectral response of PVK (polyvinyl carbazole)

FIG. 6 graphically shows the spectral photocurrent response and the absorption spectrum of PVK which may be used as a material to form the second photoconductive layer 24. The sample comprises 15 μm thick PVK layer which is sandwiched between Au and Nesa glass and the measurement is made in a high vacuum. Curves 1 and 3 indicate the spectral photocurrent response when the Nesa glass is connected to the ground and a voltage of plus 2 and 50 volts, respectively, is applied to the Au electrode. Curves 2 and 4 indicate the spectral photocurrent response when the Au electrode is connected to the ground while a voltage of minus 2 and 50 volts, respectively, is applied to the Nesa glass. Curve 5 represents the absorption spectrum. As will be apparent from FIG. 6, PVK exhibits a reduced absorption in a region of wavelengths from 310 to 350 nm and exhibits little absorption of light having a wavelength greater than 350 nm. When such PVK is used to form the second photoconductive layer 24, a material may be chosen to form the first conductive layer 23 which is sensitive to radiation of wavelengths greater than 350 nm and is not sensitive to radiation of wavelengths below such value.

Figure 7:
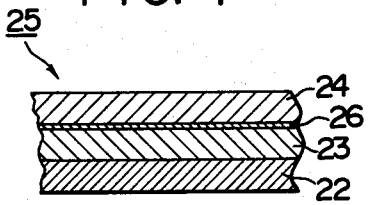
FIG. 7 is a schematic cross section of another form of photosensitive member used in the present invention.

FIG. 7 shows, in schematic cross section, another form of photosensitive member for electrophotography which may be used in carrying out the electrophotographic process of the invention. Photosensitive member 25 shown comprises a ultraviolet absorbing filter layer 26 which is interposed between a first photoconductive layer 23 and a second photoconductive layer 24. In all other respects, the photosensitive member is similar to that shown in FIG. 5. The ultraviolet absorbing filter layer 26 may comprise a light transmitting resin such as polyvinyl chloride, polymethylmethacrylate, polyethylene or the like in which a ultraviolet absorber is blended. A ultraviolet absorber may comprise benzophenones or triazoles including 2,2'-dihydroxy-4,4'-dimethoxybenzophenone
2,2'-dihydroxy-4-methoxybenzophenone
2-(2'-hydroxy-5'-methylphenyl)benzotriazole
2-(2'-hydroxy-5'-methylphenyl)-5,6-dichlorobenzotriazole A preferred thickness of the ultraviolet absorbing filter layer 26 is less than several microns. An increased thickness results in the presence of residual charge, which in turn causes a fogging in the background. A preferred proportion of the ultraviolet absorber is from 5 to 100 parts by weight with respect to 100 parts by weight of the resin when the film thickness is 1 micron.

When the ultraviolet absorbing filter layer 26 is thus formed between the first and the second photoconductive layers 23, 24, ultraviolet ray is absorbed by the filter layer 26 and cannot reach the first conductive layer 23 if the latter is sensitive to ultraviolet radiation, thus effectively preventing the first conductive layer 23 from responding to radiation in the second wavelength region. Consequently, the choice of materials to form the first and the second photoconductive layers 23, 24 is greatly facilitated.

It should be understood that instead of forming a ultraviolet absorbing filter layer 26 independently, a ultraviolet absorber of the kind described above may be dispersed into the materials which formed the first and the second photoconductive layers 23, 24 in the vicinity of a boundary therebetween to provide an effective filtering action. Alternatively, a ultraviolet absorber of a relatively low concentration may be uniformly dispersed throughout the material which forms the second photoconductive layer 24.

The electrophotographic copying process of the invention will now be described assuming that the photosensitive member 25 shown in FIG. 7 is used in which both the first and the second photoconductive layers 23, 24 has an equal capacitance and in which the first photoconductive layer 23 is capable of withstanding a voltage in excess of 500 volts while the second photoconductive layer 24 is capable of withstanding a voltage in excess of 1000 volts. In the present invention, both a positive and a negative electrostatic latent image can be selectively formed on the photosensitive member 25, but the formation of the positive latent image will be described first, followed by a description of subsequent steps to produce a positive copy image.

When a positive electrostatic latent image is to be formed, an image 30 of an original formed by visible light in the first wavelength region is projected onto the photosensitive member 25 while simultaneously projecting a corona ion current of a positive polarity from a corona charger 27 so that the surface potential reaches a value of 1000 volts, for example, as illustrated in FIG. 8(I). As a result of such imagewise irradiation which occurs simultaneously with the charging, charges of opposite polarities are trapped on the opposite surfaces of the second photoconductive layer 24 in a bright area of the image, with the surface potential reaching a level of plus 1000 volts, as indicated by broken lines in FIG. 9. In a dark area of the image, charges of opposite polarities are trapped on the surface of the second photoconductive layer 24 and on the boundary surface between the conductive layer 22 and the first conductive layer 23, and the surface potential reaches a level of plus 1000 volts as before, as indicated by a solid line in FIG. 9. However, the amount of the latter charge trapped is approximately onehalf the amount of the charge trapped in the former, so that the rising rate of the latter charging is more rapid than that of the former. Substantially the same surface potential can be reached in both the bright and the dark area of the image by continuing the charging step over a sufficient length of time until a saturation is reached or by utilizing a Scorotron charger for the charger 27 to apply a bias voltage to the Scorotron grid which is substantially equal to the desired charging potential.

Figure 8:
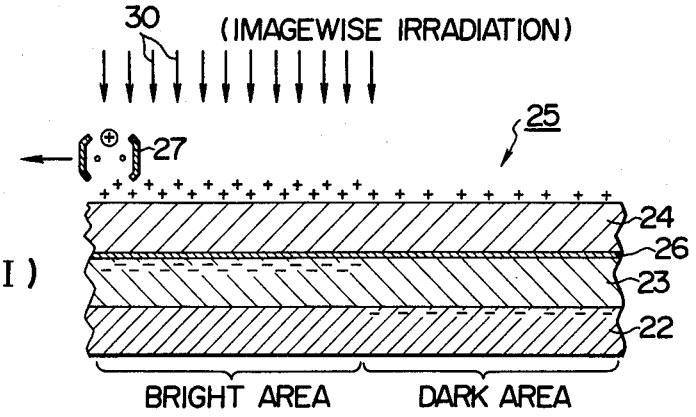
FIGS. 8(I), (II) and (III) schematically illustrate a sequence of copying steps when a positive copy image is to be produced in accordance with the process of the invention.
Figure 8:
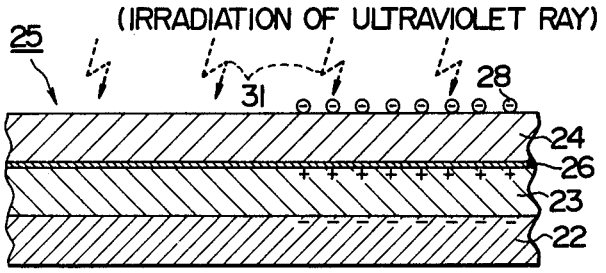
Figure 8:
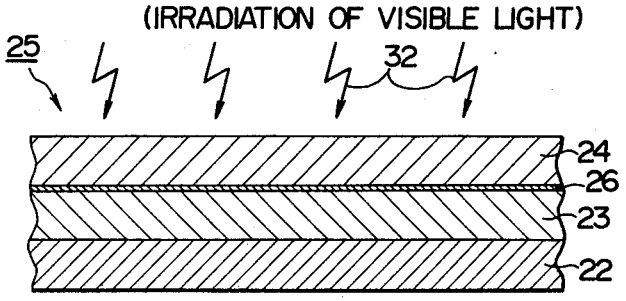
Figure 9:
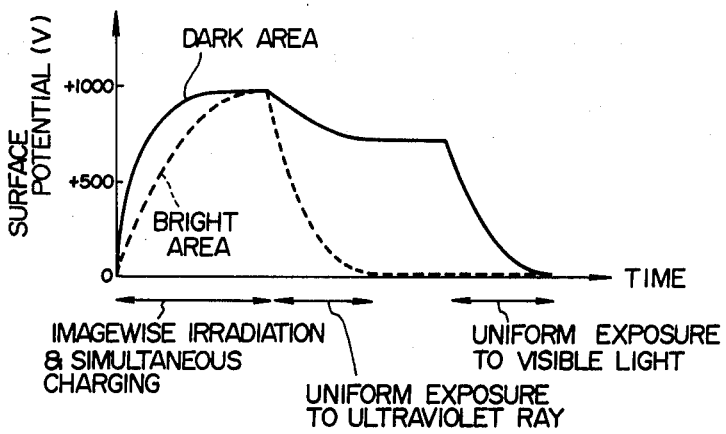
FIG. 9 graphically illustrates a change with time of the surface potential of the photosensitive member during the copying steps illustrated in FIG. 8.

Subsequent to the imagewise irradiation simultaneous with the charging, the photosensitive member is subjected to a uniform exposure 31 by ultraviolet ray of the second wavelength region, as indicated in FIG. 8(II). Upon irradiation of the ultraviolet ray, the latter is absorbed by the second photoconductive layer 24 and the ultraviolet absorbing filter layer 26, and thus cannot reach the first conductive layer 23. Thus, during this step, the first photoconductive layer 23 serves as an insulating layer. By contrast, the second photoconductive layer 24 produces carrier pairs in response to the irradiation of the ultraviolet ray, whereby the charges trapped on the surface of the second photoconductive layer 24 and the boundary between the second photoconductive layer and the ultraviolet absorbing filter layer 26 are neutralized in the bright area of the image, whereby the surface potential is reduced to substantially zero volts as indicated in FIG. 9. In the dark area of the image, the charge present on the surface of the second photoconductive layer 24 migrates to the interface between the first and the second photoconductive layers 23, 24 where it is trapped, and consequently the surface potential is slightly attenuated from the initial potential of plus 1000 volts. In this manner, a positive electrostatic latent image is formed principally by the charge which is trapped in the dark area of the image.

After the latent image is formed, a toner 28 which is negatively charged is deposited thereon to convert it into a visible image, as shown in FIG. 8(II), and then follows a transfer step in which the positive toner image is transferred onto a record sheet, thus producing a positive copy image.

After the positive copy image has been obtained, the photosensitive member 25 is subject to a uniform exposure by visible light 32 of the first wavelength region, as indicated in FIG. 8(III). This causes the charges which are trapped on the first and the second photoconductive layers 23, 24 as well as in the interface between the first photoconductive layer 23 and the conductive layer 22 are neutralized, whereby the surface potential reduces to zero to remove the latent image, allowing the photosensitive member to be prepared for the next formation of an electrostatic latent image in response to a next imagewise irradiation.

Figure 11:
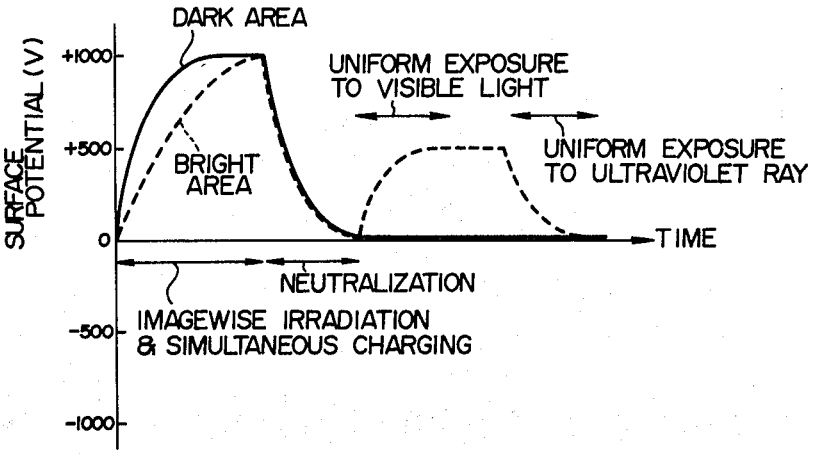
FIG. 11 graphically shows a change with time of the surface potential of the photosensitive member during the copying steps illustrated in FIG. 10.
Figure 10I:
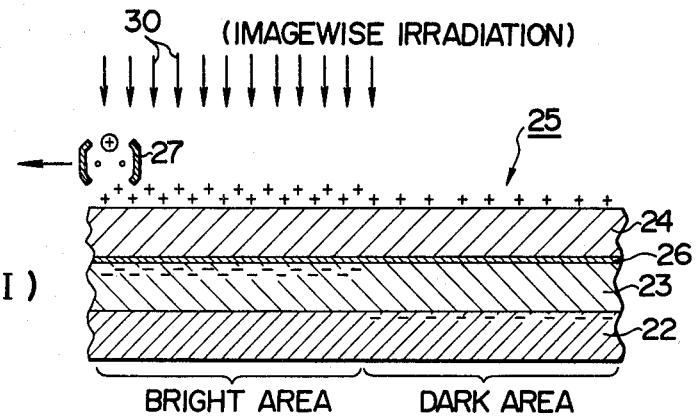
FIGS. 10(I) to (IV) schematically illustrate a sequence of copying steps when a negative copy image is to be produced in accordance with the process of the invention.
Figure 10:
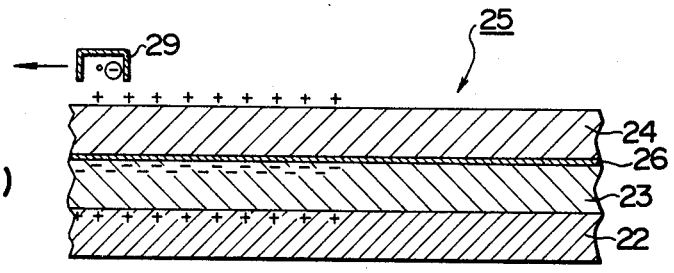
Figure 10:
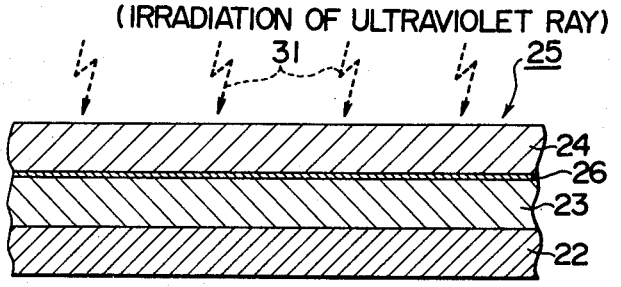

FIGS. 10 and 11 illustrate the successive steps which are followed when a negative electrostatic latent image is formed to produce a negative copy image. In this instance, as illustrated in FIG. 10(I), the photosensitive member is subjected to an imagewise irradiation 30 simultaneously with a charging thereof as described above in connection with FIG. 8(I), producing a surface potential in the bright and the dark area of the image on the order of plus 1000 volts, for example, as indicated in FIG. 11.

Subsequently, as indicated in FIG. 10(II), a corona charger 29 is moved over the photosensitive member in darkness so that the surface potential is reduced to substantially zero volt. This neutralization step can be achieved by utilizing a d.c. corona charger of the opposite polarity from that used during the step of FIG. 10(I), by using an a.c. corona charger or by utilizing a Scorotron charger with its grid connected to the ground. As a result of such neutralization, the charge is completely eliminated from the dark area of the image, which therefore assumes a surface potential of zero volt. In the bright area of the image, the charge which has been trapped between the first and the second photoconductive layers 23, 24 during the previous step remains unchanged, but a charge of the opposite polarity from the trapped charge and which is one-half the amount of such charge is trapped on the surface of the second photoconductive layer 24 and in the interface between the first photoconductive layer 23 and the conductive layer 22, so that the surface potential is apparently zero volts, with result that the entire surface potential assumes zero volts.

After the neutralization step, the photosensitive member 25 is subjected to a uniform exposure 32 by visible light in the first wavelength region, as indicated in FIG. 10(III). Upon irradiation of the visible light, the second photoconductive layer 24 remains insensitive and serves as an insulating layer while the first photoconductive layer 23 produces carrier pairs, with the holes acting to neutralize approximately one-half the negative charge which has been trapped in the interface between the first and the second photoconductive layers 23, 24 while the electrons are driven by an electric field for migration and injection into the conductive layer 22 where they are extinguished. As a consequence, the surface potential in the bright area of the image will rise to approximately plus 500 volts, forming a negative electrostatic latent image.

As indicated in FIG. 10(III), a toner 28 which is negatively charged is deposited on the latent image to convert it into a visible image, which is then transferred onto a record sheet to produce a negative copy image. After the copy image has been obtained, the photosensitive member is subjected to a uniform exposure 31 by the ultraviolet ray in the second wavelength region, in contrast to the procedure of FIG. 8(III), whereby the latent image is removed, thus preparing the photosensitive member for the next formation of a latent image.

What is claimed is:

1. An electrophotographic copying process for selectively forming a positive or a negative electrostatic latent image utilizing a photosensitive member for electrophotography which includes a conductive layer carrying a sequential lamination of a first and a second photoconductive layer thereon, the first photoconductive layer having a range of photoconductive response extending over a range of light rays from ultraviolet rays to visible light rays and defined as a first wavelength region, the second photoconductive layer being sensitive only to ultraviolet rays and defined as a second wavelength region, the process comprising a selective use of:

(A) a step of charging the photosensitive member simultaneously with an irradiation thereof with an image of an original which is formed by radiation in the first wavelength region, followed by a uniform exposure of the photosensitive member to radiation in the second wavelength region to trap a charge in a portion of the photosensitive member corresponding to a dark area of the image to form a positive electrostatic latent image; or (B) a step of charging the photosensitive member simultaneously with an irradiation thereof with an image of an original which is formed by radiation of the first wavelength region, followed by an inverse charging which reduces the entire surface potential to substantially zero, subsequently followed by a uniform exposure of the photosensitive member to radiation in the first wavelength region to trap a charge in a portion of the photosensitive member corresponding to a bright area of the image to form a negative electrostatic latent image.

2. An electrophotographic copying process according to claim 1 in which the step of inverse charging during the formation of the negative latent image takes place in darkness.

3. An electrophotographic copying process according to claim 1 in which the charging step of (A) and (B), which occurs simultaneously with the irradiation of the image, is performed by using a Scorotron charger.

4. An electrophotographic copying process according to claim 1 wherein the step of irradiation in the first wavelength region is irradiation with visible light and wherein the step of exposure to radiation in the second wavelength region is radiation with ultraviolet rays.

* * * * *